US012577647B2

(12) United States Patent
Iwasaki et al.

(10) Patent No.: US 12,577,647 B2
(45) Date of Patent: Mar. 17, 2026

(54) FILM-FORMING MATERIAL, FILM-FORMING SLURRY, SPRAY COATED FILM, AND SPRAY COATED MEMBER

(71) Applicant: Shin-Etsu Chemical Co., Ltd., Tokyo (JP)

(72) Inventors: Ryo Iwasaki, Echizen (JP); Yuji Kimura, Echizen (JP); Shigeyuki Nakamura, Echizen (JP); Hajime Nakano, Echizen (JP); Kohei Maruko, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 84 days.

(21) Appl. No.: 18/273,086

(22) PCT Filed: Dec. 22, 2021

(86) PCT No.: PCT/JP2021/047602
§ 371 (c)(1),
(2) Date: Jul. 19, 2023

(87) PCT Pub. No.: WO2022/163234
PCT Pub. Date: Aug. 4, 2022

(65) Prior Publication Data

US 2024/0301540 A1 Sep. 12, 2024

(30) Foreign Application Priority Data

Jan. 28, 2021 (JP) ..... 2021-011940

(51) Int. Cl.
*C23C 4/11* (2016.01)
*C23C 4/134* (2016.01)

(52) U.S. Cl.
CPC ..... *C23C 4/11* (2016.01); *C23C 4/134* (2016.01)

(58) Field of Classification Search
CPC ... C23C 4/11; C23C 4/134; C23C 4/04; C01F 17/20; C01F 17/212; C01F 17/218; C01F 17/224; C01F 17/265
See application file for complete search history.

(56) References Cited

U.S. PATENT DOCUMENTS

2015/0096462 A1 4/2015 Fukagawa et al.
2015/0307715 A1 10/2015 Sato et al.
(Continued)

FOREIGN PATENT DOCUMENTS

JP 2016-211071 A 12/2016
JP 2017-82325 A 5/2017
(Continued)

OTHER PUBLICATIONS

Office Action dated Sep. 17, 2024, issued in counterpart JP application No. 2024-001625, with English translation. (6 pages).
(Continued)

*Primary Examiner* — Anthony J Zimmer
*Assistant Examiner* — Syed T Iqbal
(74) *Attorney, Agent, or Firm* — WHDA, LLP

(57) ABSTRACT

The film is formed using one of two film-forming materials. The first film-forming material contains: particles containing a crystal phase of a rare earth element fluoride; particles containing a crystal phase of a rare earth element oxide; and particles containing a crystal phase of a rare earth element ammonium fluoride double salt. The second film-forming material contains: particles containing a crystal phase of a rare earth element fluoride; and particles containing a crystal phase of a rare earth element oxide and a crystal phase of a rare earth element ammonium fluoride double salt. If a spray coated film is to be formed by means of thermal spraying using this film-forming material or film-forming slurry in
(Continued)

particular, it is possible to form a rare earth element oxyfluoride spray coated film without the need for excessive heat.

25 Claims, 1 Drawing Sheet

(56) References Cited

U.S. PATENT DOCUMENTS

| | | | | |
|---|---|---|---|---|
| 2016/0326059 | A1 | 11/2016 | Nagayama et al. | |
| 2017/0114440 | A1* | 4/2017 | Takai | H01J 37/32495 |
| 2017/0282221 | A1 | 10/2017 | Lee et al. | |
| 2017/0370007 | A1 | 12/2017 | Iguchi et al. | |
| 2018/0127318 | A1 | 5/2018 | Nagayama et al. | |
| 2019/0264315 | A1 | 8/2019 | Takai et al. | |
| 2019/0264316 | A1 | 8/2019 | Takai et al. | |
| 2019/0264317 | A1 | 8/2019 | Takai et al. | |
| 2020/0024745 | A1* | 1/2020 | Kimura | C23C 24/04 |
| 2020/0056278 | A1 | 2/2020 | Iwasaki et al. | |
| 2021/0189541 | A1 | 6/2021 | Iwasaki et al. | |
| 2021/0189542 | A1 | 6/2021 | Iwasaki et al. | |
| 2023/0072803 | A1 | 3/2023 | Kimura et al. | |

FOREIGN PATENT DOCUMENTS

| | | | |
|---|---|---|---|
| JP | 2018-76546 | A | 5/2018 |
| JP | 2018-184657 | A | 11/2018 |
| JP | 2019-519091 | A | 7/2019 |
| JP | 2020-15978 | A | 1/2020 |
| JP | 2020-29614 | A | 2/2020 |
| WO | 2014/002580 | A1 | 1/2014 |
| WO | 2015/019673 | A1 | 2/2015 |
| WO | 2021/145341 | A1 | 7/2021 |

OTHER PUBLICATIONS

International Search Report dated Mar. 15, 2022, issued in counterpart International Application No. PCT/JP2021/047602 (2 pages).

* cited by examiner

FILM-FORMING MATERIAL, FILM-FORMING SLURRY, SPRAY COATED FILM, AND SPRAY COATED MEMBER

TECHNICAL FIELD

The present invention relates to a film-forming material and a film-forming slurry which are capable of forming a film such as a sprayed coating that excels as a corrosion-resistant coating on semiconductor equipment components, to sprayed coatings obtained by thermally spraying these, and to a spray-coated member provided with such a sprayed coating.

BACKGROUND ART

With recent advances in semiconductor integration, there is an emerging need for the linewidths formed on wafers by dry etching to be 10 nm or less, and so a decrease in the amount of particles that arise during semiconductor fabrication is desired. Studies are being conducted on rare-earth oxyhalide films formed by atmospheric plasma spraying (APS) as coatings that provide the low particle properties required of corrosion-resistant coatings for semiconductor equipment components. For example, WO 2014/002580 A1 (Patent Document 1) discloses, as such a spray-coating material, an yttrium oxyfluoride-containing spray-coating material.

Development is also underway on rare-earth oxyfluoride coatings formed by atmospheric suspension plasma spraying (SPS), which is expected to lead to further improvement in the low particle properties. WO 2015/019673 (Patent Document 2) discloses, as one spray-coating material for this purpose, a spray-coating slurry which contains rare earth oxyfluoride-containing particles and a dispersion medium. However, because sprayed coatings formed by atmospheric suspension plasma spraying are obtained by way of a high-power spray plume, oxidation reactions proceed more readily within an atmospheric spraying environment than by atmospheric plasma spraying, and so a large amount of oxides end up forming in the resulting sprayed coating.

Rare-earth oxyfluoride sprayed coatings have hitherto been obtained by spraying a rare-earth fluoride, rare-earth oxyfluoride, rare-earth oxide or the like, either alone or in admixture. When a rare-earth fluoride is atmospheric suspension plasma sprayed, for example, even if a rare-earth oxyfluoride sprayed coating is obtained, a large amount of rare-earth fluoride ends up remaining within the sprayed coating. When a rare-earth oxyfluoride is used, even if a rare-earth oxyfluoride sprayed coating is obtained, oxidation reactions proceed in an air atmosphere during the spraying process, resulting in the formation of a large amount of rare-earth oxide as by-product in the sprayed coating. On the other hand, when a mixture of a rare-earth fluoride and a rare-earth oxyfluoride or a mixture of a rare-earth fluoride and a rare-earth oxide is used, thermal spraying under high-power conditions is needed to react these in a very brief time during the spraying process and obtain a rare-earth oxyfluoride sprayed coating. As a result, oxidation of the molten particles proceeds at the same time as the reaction, resulting in the formation of a large amount of rare-earth oxide as by-product in the coating. These residues and by-products are thought to be one cause of particle formation.

PRIOR ART DOCUMENTS

Patent Documents

Patent Document 1: WO 2014/002580 A1
Patent Document 2: WO 2015/019673 A1

SUMMARY OF INVENTION

Technical Problem

In light of the above circumstances, the object of the present invention is to provide a film-forming material that is suitable as, for example, a spray-coating material and a film-forming slurry that is suitable as a slurry for thermal spray-coating, which film-forming material and film-forming slurry, even when used in the formation of a coating, particularly thermal spraying in an air atmosphere such as atmospheric plasma spraying (APS) or atmospheric suspension plasma spraying (SPS), suppresses the residual presence or formation as by-products of rare-earth oxides and rare-earth fluorides in the sprayed coating and is able to form a rare-earth oxyfluoride sprayed coating having a low ratio of rare-earth oxide or rare-earth fluoride present. Further objects of the invention are to provide a rare-earth oxyfluoride sprayed coating with low particle properties in which the ratio of rare-earth oxide or rare-earth fluoride present is low, and a thermally sprayed member having this sprayed coating thereon.

Solution to Problem

The inventors have conducted intensive and repeated investigations in order to achieve these objects. As a result, they have discovered that a film-forming material which contains particles containing a crystal phase of a rare-earth fluoride, particles containing a crystal phase of a rare-earth oxide and particles containing a crystal phase of an ammonium rare-earth fluoride double salt, particularly a film-forming material in which the particles containing a crystal phase of a rare-earth oxide and the particles containing a crystal phase of an ammonium rare-earth fluoride double salt form composite particles in which they are mutually dispersed, or a film-forming material which contains particles containing a crystal phase of a rare-earth fluoride and particles containing a crystal phase of a rare-earth oxide and a crystal phase of an ammonium rare-earth fluoride double salt, particularly a film-forming material in which the particles containing a crystal phase of a rare-earth oxide and a crystal phase of an ammonium rare-earth fluoride double salt form composite particles in which particles containing a crystal phase of a rare-earth oxide serve as the matrix and particles or a layer containing a crystal phase of an ammonium rare-earth fluoride double salt are dispersed at the surfaces and/or interior of the particles containing a crystal phase of a rare-earth oxide, excels as a material for use in film formation, and in particular is a film-forming material that excels as a spray-coating material capable of easily forming a rare-earth oxyfluoride sprayed coating containing little rare-earth fluoride and little rare-earth oxide. They have also discovered that a film-forming slurry containing such a film-forming material excels as a spray-coating slurry. These discoveries ultimately led to the present invention.

Accordingly, the present invention provides the following film-forming material, film-forming slurry, sprayed coating and spray-coated member.

1. A film-forming material which includes particles containing a crystal phase of a rare-earth fluoride, particles containing a crystal phase of a rare-earth oxide and particles containing a crystal phase of an ammonium rare-earth fluoride double salt.
2. The film-forming material of 1 above, wherein the particles containing a crystal phase of a rare-earth oxide and the particles containing a crystal phase of an ammonium rare-earth fluoride double salt form composite particles in which they are mutually dispersed.
3. The film-forming material of 1 or 2 above, wherein the particles containing a crystal phase of a rare-earth oxide are rare-earth oxide particles and the particles containing a crystal phase of an ammonium rare-earth fluoride double salt are ammonium rare-earth fluoride double salt particles.
4. A film-forming material which includes particles containing a crystal phase of a rare-earth fluoride and particles containing a crystal phase of a rare-earth oxide and a crystal phase of an ammonium rare-earth fluoride double salt.
5. The film-forming material of 4 above, wherein the particles containing a crystal phase of a rare-earth oxide and a crystal phase of an ammonium rare-earth fluoride double salt form composite particles in which particles containing a crystal phase of a rare-earth oxide serve as a matrix and particles or a layer containing a crystal phase of an ammonium rare-earth fluoride double salt are dispersed at a surface and/or interior of the particles containing a crystal phase of a rare-earth oxide.
6. The film-forming material of 4 or 5 above, wherein the particles containing a crystal phase of a rare-earth oxide are rare-earth oxide particles, and the particles or layer containing a crystal phase of an ammonium rare-earth fluoride double salt are particles or a layer of an ammonium rare-earth fluoride double salt.
7. The film-forming material of any of 1 to 6 above, wherein the particles containing a crystal phase of a rare-earth fluoride are rare-earth fluoride particles.
8. The film-forming material of any of 1 to 7 above, wherein the material does not contain a crystal phase of a rare-earth oxyfluoride.
9. The film-forming material of any of 1 to 8 above, wherein the ammonium rare-earth fluoride double salt includes one or more selected from the group consisting of $(NH_4)_3R^3F_6$, $NH_4R^3F_4$, $NH_4R^3{}_2F_7$ and $(NH_4)_3R^3{}_2F_9$ (wherein each $R^3$ is one or more selected from rare-earth elements inclusive of Sc and Y).
10. The film-forming material of any of 1 to 9 above, wherein the material has an oxygen content of from 0.3 to 10 wt %.
11. The film-forming material of any of 1 to 10 above wherein, at crystal phase diffraction peaks detected within a diffraction angle range of 2θ=10 to 70° in x-ray diffraction using the CuKα line as the characteristic x-ray, $X_{F0}$ computed from the formula $$X_{F0} = I(RNF)/(I(RF) + I(RO))$$

(wherein I(RNF) is the integrated intensity of the largest diffraction peak attributable to the ammonium rare-earth fluoride double salt, I(RF) is the integrated intensity of the largest diffraction peak attributable to the rare-earth fluoride, and I(RO) is the integrated intensity of the largest diffraction peak attributable to the rare-earth oxide) has a value of 0.01 or more.

12. The film-forming material of any of 1 to 11 above, wherein the particles containing a crystal phase of a rare-earth fluoride have an average particle size D50 (F1), defined as the cumulative 50% size (median size) in the volume-based particle size distribution measured after mixing the particles in 30 mL of pure water and one minute of ultrasonic dispersion treatment at 40 W, of from 0.5 to 10 μm.
13. The film-forming material of any of 1 to 12 above wherein, in the particle size distribution of the particles containing a crystal phase of a rare-earth fluoride, the value of $P_D$ computed from the following formula $$P_D = ((D90(F1) - D10(F1))/D50(F1)$$

(wherein D90(F1) is the cumulative 90% size in the volume-based particle size distribution measured after mixing the particles in 30 mL of pure water and one minute of ultrasonic dispersion treatment at 40 W, D10(F1) is the cumulative 10% size in the volume-based particle size distribution measured after mixing the particles in 30 mL of pure water and one minute of ultrasonic dispersion treatment at 40 W, and D50(F1) is the cumulative 50% size (median size) in the volume-based particle size distribution measured after mixing the particles in 30 mL of pure water and one minute of ultrasonic dispersion treatment at 40 W) is 4 or less.

14. The film-forming material of any of 1 to 13 above, wherein the particles containing a crystal phase of a rare-earth fluoride have a BET specific surface area of 10 $m^2/g$ or less.
15. The film-forming material of any of 1 to 14 above, wherein the particles containing a crystal phase of a rare-earth fluoride has a loose bulk density of at least 0.6 $g/cm^3$.
16. The film-forming material of any of 1 to 15 above, wherein the material is in the form of a powder or granules.
17. The film-forming material of 16 above, wherein the material has an average particle size D50(S0), defined as the cumulative 50% size (median size) in a volume-based particle size distribution, of from 10 to 100 μm.
18. A film-forming slurry containing the film-forming material of any of 1 to 15 above and a dispersion medium.
19. The film-forming slurry of 18 above, wherein the slurry has a concentration of from 10 to 70 wt %.
20. The film-forming slurry of 18 or 19 above, wherein the dispersion medium includes a nonaqueous solvent.
21. The film-forming slurry of any of 18 to 20 above, wherein the slurry has an average particle size D50(S1), defined as the cumulative 50% size (median size) in the volume-based particle size distribution measured after mixing the particles in 30 mL of pure water and one minute of ultrasonic dispersion treatment at 40 W, of from 1 to 10 μm.
22. The film-forming slurry of any of 18 to 21 above, wherein the value of $P_{SA}$ computed from the following formula $$P_{SA} = D50(S1)/D50(S3)$$

(wherein D50(S1) is an average particle size defined as the cumulative 50% size (median size) in the volume-based particle size distribution measured after mixing the slurry in 30 mL of pure water and one minute of ultrasonic dispersion treatment at 40 W and D50(S3) is an average particle size defined as the cumulative 50% size (median size) in the volume-based particle size distribution measured after mixing the slurry in 30 mL of pure water and 3 minutes of ultrasonic dispersion treatment at 40 W) is at least 1.04.

23. The film-forming slurry of any of 18 to 22 above, wherein the film-forming material has a loss on ignition in air at 500° C. for 2 hours of at least 0.5 wt %.
24. The film-forming material of any of 1 to 17 above which is a spray-coating material.
25. The film-forming slurry of any of 18 to 23 above which is a spray-coating slurry.
26. A sprayed coating obtained by thermally spraying the film-forming material of 24 above or the film-forming slurry of 25 above.
27. A spray-coated member which includes the sprayed coating of 26 above on a substrate.
28. The spray-coated member of 27 above which is a semiconductor equipment component.

Advantageous Effects of Invention

The film-forming material or film-forming slimy of the invention, particularly when using a film-forming material or film-forming slurry to form a sprayed coating by thermal spraying, is able to form a rare-earth oxyfluoride sprayed coating without requiring an excessive amount of heat. As a result, a rare-earth oxyfluoride sprayed coating containing little rare-earth fluoride and rare-earth oxide can be obtained while keeping oxidation reactions due to the heat of thermal spraying from proceeding even in air. In addition, coating separation due to the influence of an excessive amount of heat can be suppressed.

DESCRIPTION OF EMBODIMENTS

Figure 1:
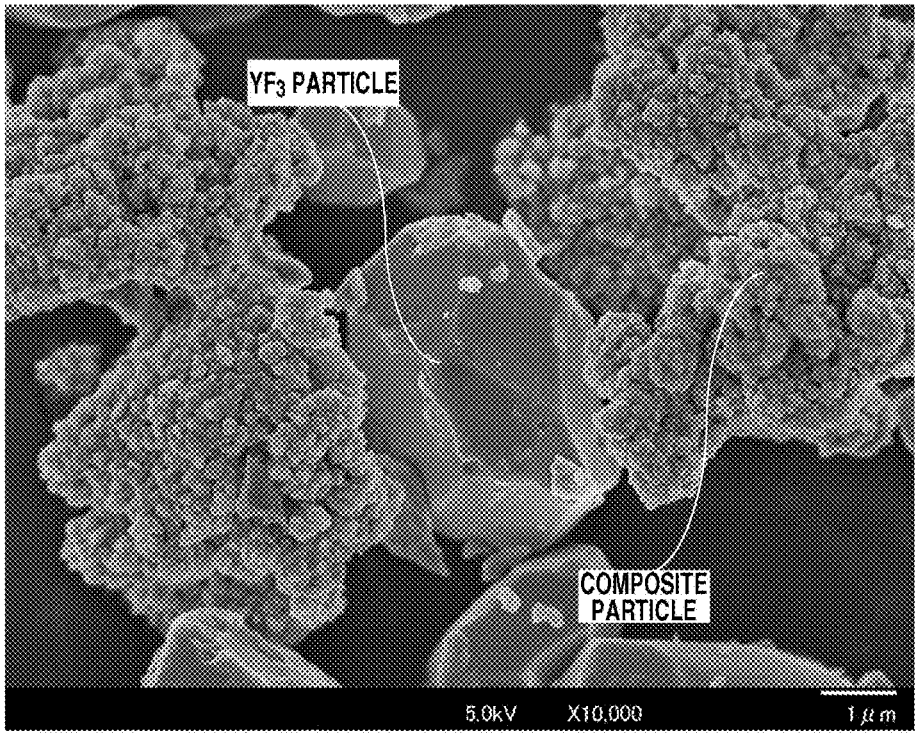
FIG. 1 is a scanning electron micrograph of the film-forming material obtained in Example 1.

The invention is described in greater detail below.

The film-forming material of the present invention includes a crystal phase of a rare-earth fluoride, a crystal phase of a rare-earth oxide and a crystal phase of an ammonium rare-earth fluoride double salt. The film-forming material of the invention can be used in a powdery, granular or other solid form to carry out film formation by thermal spraying, physical vapor deposition (PVD), aerosol deposition (AD) or the like. In the case of thermal spraying, atmospheric plasma spraying (APS) is preferred. The film-forming material of the invention may be rendered into a film-forming slurry which contains a film-forming material and a dispersion medium. When the film-forming material is used in the form of a slurry, a spray-coating slurry is preferred. A spray-coating slurry is suitable for atmospheric suspension plasma spraying (SPS).

Included among the film-forming materials of the invention are film-forming materials which contain particles containing a crystal phase of a rare-earth fluoride, particles containing a crystal phase of a rare-earth oxide and particles containing a crystal phase of an ammonium rare-earth fluoride double salt (first film-forming material embodiment). In this first film-forming material embodiment, it is preferable for the particles containing a crystal phase of a rare-earth oxide and the particles containing a crystal phase of an ammonium rare-earth fluoride double salt to form composite particles in which they are mutually dispersed (first composite particle embodiment). Also, it is preferable for the first film-forming material embodiment to be a mixture, or granulated particles, of particles containing a crystal phase of a rare-earth fluoride and composite particles of the first embodiment. Additionally, in the case of the first film-forming material embodiment, it is preferable for the particles containing a crystal phase of a rare-earth fluoride to be rare-earth fluoride particles, for the particles containing a crystal phase of the rare-earth oxide to be rare-earth oxide particles, and for the particles containing a crystalline state of the ammonium rare-earth fluoride double salt to be ammonium rare-earth fluoride double salt particles.

Also included among the film-forming materials of the invention are film-forming materials which contain particles containing a crystal phase of a rare-earth fluoride and particles containing a crystal phase of a rare-earth oxide and a crystal phase of an ammonium rare-earth fluoride double salt (second film-forming material embodiment). In this second film-forming material embodiment, the particles containing a crystal phase of a rare-earth oxide and a crystal phase of an ammonium rare-earth fluoride double salt form composite particles in which particles containing a crystal phase of a rare-earth oxide serve as a matrix and particles or a layer containing a crystal phase of an ammonium rare-earth fluoride double salt are dispersed at surfaces and/or interiors of the particles containing a crystal phase of a rare-earth oxide (second composite particle embodiment). It is preferable for the second film-forming material embodiment to be a mixture, or granulated particles, of particles containing a crystal phase of a rare-earth fluoride and composite particles of the second embodiment. Additionally, in the case of the second film-forming material embodiment, it is preferable for the particles containing a crystal phase of a rare-earth fluoride to be rare-earth fluoride particles, for the particles containing a crystal phase of the rare-earth oxide to be rare-earth oxide particles, and for the particles or layer containing a crystalline state of the ammonium rare-earth fluoride double salt to be particles or a layer of ammonium rare-earth fluoride double salt.

Therefore, in both the first and second film-forming material embodiments, the composite particles contain a crystal phase of a rare-earth oxide and a crystal phase of an ammonium rare-earth fluoride double salt. Also, in both the first and second film-forming material embodiments, the particles containing a crystal phase of a rare-earth fluoride are preferably particles which are composed solely of a rare-earth fluoride and contain no other ingredients, and are preferably particles in which the crystal phase is substantially composed solely of a crystal phase of a rare-earth fluoride. In this case, particles or a layer of an ammonium rare-earth fluoride double salt become abundantly present in the vicinity of the particles containing a crystal phase of a rare-earth oxide, which is advantageous. Moreover, in both the first and second film-forming material embodiments, the composite particles (first and second composite particle embodiments) may contain small amounts of ingredients other than the rare-earth oxide and the ammonium rare-earth fluoride double salt, although they are preferably particles substantially composed solely of a rare-earth oxide and an ammonium rare-earth fluoride double salt, and are preferably particles in which the crystal phase is substantially composed solely of a crystal phase of a rare-earth oxide and a crystal phase of an ammonium rare-earth fluoride double salt.

The film-forming material of the invention preferably does not contain a crystal phase of a rare-earth oxyfluoride. Compared with rare-earth fluorides and rare-earth oxides, rare-earth oxyfluorides are unstable compounds. If a rare-earth oxyfluoride is included within the film-forming material, when the material is used in thermal spraying, for example, oxidation reactions on the rare-earth oxyfluoride proceed preferentially in the course of the thermal spraying process and the amount of rare-earth oxide within the sprayed coating obtained by thermally spraying the film-forming material sometimes ends up rising.

Examples of the rare-earth fluoride in the invention include $R^1F_2$ and $R^1F_3$ (wherein $R^1$ is one or more element selected from the rare-earth elements inclusive of Sc and Y). The rare-earth fluoride may be of one single type or may be a mixture of two or more types. Also, $R^1$ may be common to some or all of the rare-earth fluorides, or may differ in the respective rare-earth fluorides.

Examples of the rare-earth oxide in the invention include $R^2O$ and $R^2{}_2O_3$ (wherein $R^2$ is one or more element selected from the rare-earth elements inclusive of Sc and Y). The rare-earth oxide may be of one single type or may be a mixture of two or more types. Also, $R^2$ may be common to some or all of the rare-earth oxides, or may differ in the respective rare-earth oxides.

Examples of the ammonium rare-earth fluoride double salt in the invention include $(NH_4)_3R^3F_6$, $NH_4R^3F_4$, $NH_4R^3{}_2F_7$ and $(NH_4)_3R^3{}_2F_9$ (wherein each $R^3$ is one or more selected from the rare-earth elements inclusive of Sc and Y). The ammonium rare-earth fluoride double salt may be of one single type or may be a mixture of two or more types. Also, $R^3$ may be common to some or all of the ammonium rare-earth fluoride double salts, or may differ in the respective ammonium rare-earth fluoride double salts.

Examples of the rare-earth oxyfluoride in the invention include $R^4OF$ ($R^4{}_1O_1F_1$), $R^4{}_4O_3F_6$, $R^4{}_5O_4F_7$, $R^4{}_6O_5F_8$, $R^4{}_7O_6F_9$, $R^4{}_{17}O_{14}F_{23}$, $R^4O_2F$ and $R^4OF_2$ (wherein $R^4$ is one or more element selected from the rare-earth elements inclusive of Sc and Y). The rare-earth oxyfluoride may be of one single type or a mixture of two or more types. Also, $R^4$ may be common to some or all of the rare-earth oxyfluorides, or may differ in the respective rare-earth oxyfluorides.

Aside from rare-earth fluorides, rare-earth oxides and ammonium rare-earth fluoride double salts, the film-forming material of the invention may include, as other ingredients, other rare-earth compounds such as rare-earth hydroxides and rare-earth carbonates or particles thereof, and compounds of other elements or particles thereof, within ranges that do not detract from the advantageous effects of the invention. The content of these other ingredients is preferably not more than 10 wt %, more preferably not more than 5 wt %/o, even more preferably not more than 3 wt %, and still more preferably not more than 1 wt %. It is most preferable for substantially none of these other ingredients to be included.

In cases where, as with the first and second film-forming material embodiments, the rare-earth oxide and the ammonium rare-earth fluoride double salt are included as composite particles, rare-earth oxide particles which are composed solely of rare-earth oxides and contain no other ingredients and ammonium rare-earth fluoride composite particles which are composed solely of ammonium rare-earth fluoride double salts and contain no other ingredients may be included. The total content of rare-earth oxide particles and ammonium rare-earth fluoride double salt particles relative to the composite particles is preferably not more than 10 wt %, more preferably not more than 5 wt %, even more preferably not more than 3 wt %, and still more preferably not more than 1 wt %, although it is most preferable for substantially none of these rare-earth oxide particles and ammonium rare-earth fluoride double salt particles to be included.

In this invention, the rare-earth elements include scandium (Sc), yttrium (Y) and the lanthanoid series (elements with atomic numbers from 57 to 71). Y, Sc, erbium (Er) and ytterbium (Yb) are especially suitable as the rare-earth elements.

The film-forming material of the invention has an oxygen content of preferably at least 0.3 wt %. An oxygen content of at least 0.3 wt % is advantageous in that when this film-forming material is used in, for example, thermal spraying, the amount of rare-earth fluoride within the sprayed coating obtained by thermally spraying the film-forming material can be reduced, and also in that the surface roughness of the sprayed coating can be lowered. The oxygen content is more preferably at least 0.5 wt %, even more preferably at least 1 wt %, and still more preferably at least 2 wt %. On the other hand, the oxygen content of the film-forming material of the invention is preferably not more than 10 wt %. An oxygen content of not more than 10 wt % is advantageous in that when this film-forming material is used in, for example, thermal spraying, the amount of rare-earth oxide within the sprayed coating obtained by thermally spraying the film-forming material can be reduced. The oxygen content is more preferably not more than 9 wt %, even more preferably not more than 8 wt %, and still more preferably not more than 7 wt %. During production of the film-forming material, the oxygen content relative to the overall ingredients making up the film-forming material should be suitably adjusted in order to set the oxygen content of the film-forming material within the above range. Specifically, the ratio of composite particles (first and second composite particle embodiments) within the film-forming material or the ratio of particles containing a crystal phase of a rare-earth oxide within the composite particles should be adjusted.

In the film-forming material of the invention, at crystal phase diffraction peaks detected within a diffraction angle range of $2\theta=10$ to $70°$ in x-ray diffraction using the CuKα line as the characteristic x-ray, $X_{F0}$ computed from the formula $$X_{F0} = I(RNF)/(I(RF) + I(RO))$$

(wherein I(RNF) is the integrated intensity of the largest diffraction peak attributable to the ammonium rare-earth fluoride double salt. I(RF) is the integrated intensity of the largest diffraction peak attributable to the rare-earth fluoride, and I(RO) is the integrated intensity of the largest diffraction peak attributable to the rare-earth oxide) has a value of preferably 0.01 or more. Here, when two or more compounds are present in the ammonium rare-earth fluoride double salt, in the rare-earth fluoride or in the rare-earth oxide, I(RNF), I(RF) and I(RO) are the sums of the integrated intensities of the largest diffraction peaks for each of the two or more compounds. The $NH_3$ gas that evolves with decomposition and dissociation of the ammonium rare-earth fluoride double salt has the property of combusting at high temperature; although not particularly limited, at a larger $X_{F0}$ value, more oxygen within the ambient air is consumed, which presumably suppresses oxidation of the rare-earth oxyfluoride. The value of $X_{F0}$ is more preferably at least 0.02, even more preferably at least 0.05, and still more preferably at least 0.08. On the other hand, the value of $X_{F0}$ is preferably not more than 1. An $X_{F0}$ value of not more than 1 is advantageous in that, particularly when the film-forming material is used in the form of a film-forming slurry, an increase in the slurry viscosity can be suppressed. The $X_{F0}$ value is more preferably not more than 0.8, even more preferably not more than 0.6, and still more preferably not more than 0.4.

In the film-forming material of the invention, at crystal phase diffraction peaks detected within a diffraction angle range of 2θ=10 to 70° in x-ray diffraction using the CuKα line as the characteristic x-ray, $X_F$ computed from the formula $$X_F = I(RNF)/I(RF)$$

(wherein I(RNF) is the integrated intensity of the largest diffraction peak attributable to the ammonium rare-earth fluoride double salt, and I(RF) is the integrated intensity of the largest diffraction peak attributable to the rare-earth fluoride) has a value of preferably 0.01 or more. Here, when two or more compounds are present in the ammonium rare-earth fluoride double salt or in the rare-earth fluoride, I(RNF) and I(RF) are the sums of the integrated intensities of the largest diffraction peaks for each of the two or more compounds. At an $X_F$ value of 0.01 or more, the ratio of ammonium rare-earth fluoride double salt included in the film-forming material becomes higher, which is effective in that, when this film-forming material is used in, for example, thermal spraying, oxidation reactions are kept from proceeding during the thermal spraying process. Decomposition and dissociation of the ammonium rare-earth fluoride double salt proceed in the very brief time that it is present within the thermal spraying plume, as a result of which HF and $NH_3$ gases evolve. The HF gas that has evolved, although not particularly limited, is thought to react instantaneously with the rare-earth oxide present within the film-forming material, becoming rare-earth oxyfluoride. The value of $X_F$ is more preferably at least 0.02, even more preferably at least 0.05, and still more preferably at least 0.08. On the other hand, the value of $X_F$ is preferably not more than 1. In the case of a film-forming material which includes the ammonium rare-earth fluoride double salt as composite particles with particles containing a crystal phase of a rare-earth oxide, when the ratio of ammonium rare-earth fluoride double salt included within the rare-earth film-forming material is high, the ratio of rare-earth oxide included within the rare-earth film-forming material also becomes high. As a result, when this film-forming material is used in, for example, thermal spraying, the amount of rare-earth oxide included within the sprayed coating obtained by thermally spraying the film-forming material sometimes becomes high. The value of $X_F$ is more preferably not more than 0.8, even more preferably not more than 0.6, and still more preferably not more than 0.4.

In the film-forming material of the invention, at crystal phase diffraction peaks detected within a diffraction angle range of 2θ=10 to 70° in x-ray diffraction using the CuKα line as the characteristic x-ray, $X_0$ computed from the formula $$X_0 = I(RNF)/I(RO)$$

(wherein I(RNF) is the integrated intensity of the largest diffraction peak attributable to the ammonium rare-earth fluoride double salt, and I(RO) is the integrated intensity of the largest diffraction peak attributable to the rare-earth oxide) has a value of preferably 0.01 or more. Here, when two or more compounds are present in the ammonium rare-earth fluoride double salt or the rare-earth oxide, I(RNF) and I(RO) are the sums of the integrated intensities of the largest diffraction peak for each of the two or more compounds. At an $X_0$ value of 0.01 or more, the ratio of ammonium rare-earth fluoride double salt included within the film-forming material, and especially, in the case of a film-forming material in which the ammonium rare-earth fluoride double salt is included as composite particles with particles containing a crystal phase of a rare-earth oxide, the ratio of ammonium rare-earth fluoride double salt included within the composite particles, becomes higher, which is effective in that, when the film-forming material is used in, for example, thermal spraying, the efficiency of ammonium rare-earth fluoride double salt reactions during the thermal spraying process is increased and the amount of rare-earth oxide included within the sprayed coating obtained by spraying the film-forming material can be reduced. The value of $X_0$ is more preferably 0.02 or more, even more preferably 0.05 or more, and still more preferably 0.08 or more. On the other hand, the value of $X_0$ is preferably not more than 1. At an $X_0$ value of not more than 1, when the film-forming material is used in, for example, thermal spraying, the rare-earth oxide is made to react with the rare-earth fluoride or the ammonium rare-earth fluoride double salt, enabling the rare-earth oxide to serve effectively as an oxygen source such that rare-earth oxyfluoride becomes included within the sprayed coating obtained by thermally spraying the film-forming material. The value of $X_0$ is more preferably not more than 0.8, even more preferably not more than 0.6, and still more preferably not more than 0.4.

When the rare-earth element is, for example, yttrium (Y), the largest peak for the cubic system of ammonium yttrium fluoride double salt ($NH_4Y_2F_7$), although not particularly limited, is generally a diffraction peak attributable to the (541) plane of the crystal lattice. This refraction peak is typically detected at about 2θ=27.3°. The largest peak for yttrium fluoride ($YF_3$), although not particularly limited, is generally a diffraction peak attributable to the (111) plane of the crystal lattice. This diffraction peak is typically detected at about 2θ=27.9°. The largest peak for yttrium oxide ($Y_2O_3$), although not particularly limited, is generally a diffraction peak attributable to the (222) plane of the crystal lattice. This diffraction peak is typically detected at about 2θ=29.2°.

The film-forming material of the invention can be used in a powdery, granular or other solid form in film formation such as thermal spraying, physical vapor deposition (PVD) or aerosol deposition (AD). Decomposition of the ammonium rare-earth fluoride double salt within the film-forming material proceeds at above 200° C., and so it is preferable for the film-forming material to not be subjected to firing at a temperature in excess of 200° C. When the film-forming material of the invention is produced by granulation or the like, drying at a temperature of 200° C. and below is possible. In the case of a film-forming material produced by granulation, a binder that is optionally added at the time of granulation may be included.

When using the film-forming material of the invention in a powdery, granular or other solid form, the average particle size D50(S0), defined as the cumulative 50% size (median size) in a volume-based particle size distribution, is preferably not more than 100 μm. The average particle size D50(S0) is the average particle size obtained by measuring the particle size distribution of the film-forming material directly as is without subjecting the film-forming material to pretreatment for the purpose of particle size distribution measurement, such as ultrasonic dispersion treatment. When the material is used in, for example, thermal spraying, a smaller particle size in the film-forming material is advantageous in that the splats that form due to the collision of molten particles with the substrate or a coat that has been formed on the substrate become smaller in diameter and the porosity of the sprayed coating that forms can be reduced, enabling the cracks that form within splats to be suppressed. The average particle size D50(S0) is more preferably not more than 80 μm, even more preferably not more than 60 μm, and still more preferably not more than 50 μm. On the other hand, the average particle size D50(S0) is preferably at least 10 μm. When the film-forming material is used in, for example, thermal spraying, a larger particle size is advantageous in that, because the molten particles have a large momentum, they collide with the substrate or with a coat formed on the substrate to readily form splats or in that, when feeding the film-forming material (spray-coating material) from the spray-coating material feed unit to the thermal spray gun, the flowability is better. The average particle size D50(S0) is more preferably at least 12 μm, even more preferably at least 15 μm, and still more preferably at least 18 μm.

The film-forming material of the invention can be dispersed in a dispersion medium and used in the form of a slurry in film formation. When the film-forming material is used in the form of a slurry, the film-forming slurry is suitable as a spray-coating slurry. The slurry concentration (content of film-forming material with respect to the overall slurry) is preferably not more than 70 wt %. At a film-forming material content greater than 70 wt %, when the film-forming slurry is used in thermal spraying, for example, it sometimes clogs the interior of the feed unit during thermal spraying, as a result of which it may not be possible to form a sprayed coating. The lower the content of film-forming material within the film-forming slurry, the more active the motion of the particles within the slurry and the higher the dispersibility. Also, at a lower content of film-forming material within the film-forming slurry, the flowability of the slurry increases, which is suitable for slurry feeding. The slurry concentration is more preferably not more than 65 wt %, even more preferably not more than 60 wt %, and still more preferably not more than 55 wt %. When a higher flowability is desired, the slurry concentration can be further lowered. In such cases, the concentration is preferably not more than 45 wt %, more preferably not more than 40 wt %, and even more preferably not more than 35 wt %. On the other hand, the slurry concentration is preferably at least 10 wt %. At a higher film-forming material content within the film-forming slurry, when the slurry is used in, for example, thermal spraying, the rate of film formation by the sprayed coating that is formed by thermally spraying the slurry rises, enabling the productivity to be increased. The slurry concentration is more preferably at least 15 wt %, even more preferably at least 20 wt %, and still more preferably at least 25 wt %.

The film-forming slurry includes a dispersion medium. The dispersion medium may be of one type used alone, or two or more types may be used in admixture. The dispersion medium preferably includes a nonaqueous dispersion medium; that is, a dispersion medium other than water. Exemplary nonaqueous dispersion media include, without particular limitation, alcohols, ethers, esters and ketones. More specifically, monohydric or dihydric alcohols having from 2 to 6 carbon atoms, such as ethanol and isopropyl alcohol; ethers having from 3 to 8 carbon atoms, such as ethyl cellosolve; glycol ethers having from 4 to 8 carbon atoms, such as dimethyl diglycol (DMDG); glycol esters having from 4 to 8 carbon atoms, such as ethyl cellosolve acetate and butyl cellosolve acetate; and cyclic ketones having from 6 to 9 carbon atoms, such as isophorone, are preferred. The nonaqueous dispersion medium is more preferably a water-soluble one which can mix with water. When a nonaqueous dispersion medium is mixed with water and used, the water may be included to a degree that does not detract from the advantageous effects of the invention. The amount of water that is mixed into the nonaqueous dispersion medium is preferably not more than 50 wt % with respect to the overall dispersion medium, more preferably not more than 30 wt %, even more preferably not more than 10 wt %, and still more preferably not more than 5 wt %. It is most preferable for the dispersion medium to contain substantially no dispersion medium other than the nonaqueous dispersion medium (that is, to contain substantially no water).

When the film-forming material of the invention is used in the form of a slurry, the average particle size D50(S1), defined as the cumulative 50% size (median size) in the volume-based particle size distribution measured after mixing the particles in 30 mL of pure water and one minute of ultrasonic dispersion treatment at 40 W, is preferably not more than 10 μm. At a smaller particle size, when the film-forming material is used in, for example, thermal spraying, the diameter of the splats formed by collision of the molten particles with the substrate or with a coat formed on the substrate becomes smaller and the porosity of the sprayed coating that forms can be reduced, enabling the cracks that form within splats to be suppressed. The average particle size D50(S1) is more preferably not more than 9 μm, even more preferably not more than 8 μm, and still more preferably not more than 7 μm. On the other hand, the average particle size D50(S1) is preferably at least 1 μm. When the film-forming material is used in, for example, thermal spraying, a larger particle size is advantageous in that, because the molten particles have a large momentum, they collide with the substrate or with a coat formed on the substrate, readily forming splats. The average particle size D50(S1) is more preferably at least 1.5 μm, even more preferably at least 2 μm, and still more preferably at least 2.5 μm. It is thus advantageous to use a film-forming material having an average particle size D50(S1) of from 1 to 10 μm as a film-forming slurry in order to enhance the feedability of the film-forming material.

The film-forming material of the invention, when used in the form of a slurry, has a $P_{SA}$, defined as the ratio of the average particle size D50(S1) to the average particle size D50(S3), which is the cumulative 50% size (median size) in the volume-based particle size distribution measured after mixing the particles in 30 mL of pure water and 3 minutes of ultrasonic dispersion treatment at 40 W, and expressed as $$P_{SA} = D50(S1)/D50(S3),$$

which is preferably at least 1.04. At a larger $P_{SA}$ value, the particles in the film-forming material maintain well an agglomerated state and, when the film-forming material of the invention is used in the form of a film-forming slurry, can prevent compaction due to gravitational forces when a precipitate forms, enabling the re-dispersibility of the slurry to be improved. The $P_{SA}$ value is more preferably at least 1.05, even more preferably at least 1.07, and still more preferably at least 1.09. On the other hand, from the standpoint of increasing the slurry flowability, the value of $P_{SA}$, although not particularly limited, is preferably not more than 1.3, more preferably not more than 1.28, even more preferably not more than 1.26, and still more preferably not more than 1.24.

The film-forming material of the invention preferably has a loss on ignition over 2 hours at 500° C. in air of at least 0.5 wt %. It is common to think of a smaller ignition loss as indicating a lower amount of impurities and thus being desirable. However, in the film-forming material of the invention, a loss on ignition over 2 hours at 500° C. in air of at least 0.5 wt % is advantageous because, particularly when the film-forming material is used as a film-forming slurry, the slurry re-dispersibility (ease of deflocculation) can be enhanced. The reason for this, although not particularly limited, is thought to be as follows. Within a film-forming slurry, the ammonium fluoride component of the ammonium rare-earth fluoride double salt included in the film-forming material becomes an energy barrier between mutual particles containing a crystal phase of a rare-earth fluoride, between mutual particles or mutual composite particles containing a crystal phase of a rare-earth oxide, or between particles containing a crystal phase of a rare-earth fluoride and particles containing a crystal phase of a rare-earth oxide, preventing agglomeration of the particles and enabling the particles to be easily redispersed, even after the particles have settled and a precipitate has formed. The ignition loss is more preferably at least 1 wt %, even more preferably at least 2 wt %, and still more preferably at least 3 wt %. Although there is no particular upper limit on the ignition loss, from the standpoint of the effect on the properties of films such as sprayed coatings (reduction in impurities), the ignition loss is preferably not more than 20 wt %, more preferably not more than 15 wt %, and still more preferably not more than 10 wt %.

The particles containing a crystal phase of a rare-earth fluoride that are included in the film-forming material of the invention have an average particle size D50(F1), defined as the cumulative 50% size (median size) in the volume-based particle size distribution measured after mixing the particles in 30 mL of pure water and one minute of ultrasonic dispersion treatment at 40 W, of preferably not more than 10 μm. In cases where the film-forming material is used in, for example, thermal spraying, a smaller size in the particles containing a crystal phase of a rare-earth fluoride is advantageous in that the diameter of splats that form due to the collision of molten particles with the substrate or with a coat formed on the substrate becomes smaller and the porosity of the sprayed coating that forms can be reduced, enabling the cracks that form within splats to be suppressed. The average particle size D50(F1) is more preferably not more than 9 un, even more preferably not more than 8 μm, and still more preferably not more than 7 μm. On the other hand, the average particle size D50(F1) is preferably at least 0.5 μm. When the film-forming material is used in, for example, thermal spraying, a larger particle size is advantageous in that, because the molten particles have a large momentum, they collide with the substrate or with a coat formed on the substrate to readily form splats. Also, a larger particle diameter is advantageous in that protruding asperities that form on the surface of the sprayed coating can be reduced. The average particle size D50(F1) is more preferably at least 1 μm, even more preferably at least 1.5 pun, and still more preferably at least 2 μm.

The particles containing a crystal phase of a rare-earth fluoride that are included in the film-forming material of the invention have, in the particle size distribution, a value $P_D$ computed from the following formula $$P_D = ((D90(F1) - D10(F1))/D50(F1),$$

(wherein D50(F1) is the average particle size, D90(F1) is the cumulative 90% size in the volume-based particle size distribution measured after mixing the particles in 30 mL of pure water and one minute of ultrasonic dispersion treatment at 40 W and D10(F1) is the cumulative 10% size in the volume-based particle size distribution measured after mixing the particles in 30 mL of pure water and one minute of ultrasonic dispersion treatment at 40 W) that is preferably 4 or less. The smaller the value of $P_D$, the sharper the particle size distribution and the more uniform the particle size of the material. When the film-forming material is used in, for example, thermal spraying, the variability in the properties of the sprayed coating obtained by thermally spraying the film-forming material can be suppressed. The value of $P_D$ is more preferably 2 or less, even more preferably 1.5 or less, and still more preferably 1.3 or less. The lower limit in the value of $P_D$ is ideally 0 or more; for practical purposes, it is generally at least 0.1, and preferably at least 0.5.

The particles containing a crystal phase of a rare-earth fluoride that are included in the film-forming material of the invention have, in the particle size distribution, a value $P_{FA}$ computed from the following formula $$P_{FA} = (D50(F1)/D50(F3)$$

(wherein D50(F1) is the average particle size and D50(F3) is the cumulative 50% size (median size) in the volume-based particle size distribution measured after mixing the particles in 30 mL of pure water and 3 minutes of ultrasonic dispersion treatment at 40 W) that is preferably 1.05 or less. A smaller $P_{FA}$ value enables the slurry flowability to be increased, particularly in cases where the film-forming material is used as a film-forming slurry. The value of $P_{FA}$ is more preferably 1.04 or less, even more preferably 1.03 or less, and still more preferably 1.02 or less. The lower limit in the value of $P_{FA}$ is ideally 1 or more; for practical purposes, it is generally 1.01 or more.

The particles containing a crystal phase of a rare-earth fluoride that are included in the film-forming material of the invention preferably have a specific surface area of 10 $m^2/g$ or less. The BET specific surface area measured by the BET method is generally suitable as the specific surface area. At a smaller specific surface area, in cases where the film-forming material is used in, for example, thermal spraying, it is possible to reduce the number of very small particles which do not fully enter the thermal spraying flame and deposit on surface portions of the sprayed coating that has formed, becoming a cause of particle contamination, and the number of very small particles which, when they have entered the thermal spraying flame, end up vaporizing due to excess thermal spraying heat. The specific surface area is more preferably 5 $m^2/g$ or less, even more preferably 2 $m^2/g$ or less, and still more preferably 1 $m^2/g$ or less. No particular lower limit is imposed on the specific surface area, although this is preferably at least 0.01 $m^2/g$. In cases where the film-forming material is used in, for example, thermal spraying, a larger specific surface area is advantageous in that the heat of the thermal spraying plume when the material is thermally sprayed readily penetrates to the interior of the particles and the molten particles collide with the substrate or with a coat formed on the substrate to form splats, at which time the coating readily becomes dense and bonds between the splats become strong. The specific surface area is more preferably at least 0.05 $m^2/g$, even more preferably at least 0.1 $m^2/g$, and still more preferably at least 0.3 $m^2/g$.

The particles containing a crystal phase of a rare-earth fluoride that are included in the film-forming material of the invention have a bulk density of preferably at least 0.6 $g/cm^3$. The loose bulk density is generally suitable as the bulk density. In cases where the film-forming material is used in, for example, thermal spraying, a higher bulk density is advantageous in that splats easily form when plasma spraying is carried out, and the sprayed coating obtained by thermally spraying the film-forming material readily becomes dense. This is also advantageous in that, because the amount of gas components contained in voids among the particles is low, the risk of a worsening in the properties of the sprayed coating that is formed can be reduced. The bulk density is more preferably at least 0.65 $g/cm^3$, even more preferably at least 0.7 $g/cm^3$, and still more preferably at least 0.75 $g/cm^3$.

By using the film-forming material or film-forming shiny of the invention to carry out thermal spraying, a rare-earth oxyfluoride-containing sprayed coating (surface layer coat) well-suited for semiconductor equipment components and the like can be formed on a substrate, e.g., either directly on the substrate or over an undercoat (underlayer coat), making it possible to produce a spray-coated member having a sprayed coating (surface layer coat) formed on a substrate, e.g., either directly on the substrate or over an undercoat (underlayer coat). This spray-coated member is suitable as a semiconductor equipment component. The sprayed coating (surface layer coat) of the invention has a film thickness that is preferably at least 10 μm, and more preferably at least 30 μm. The upper limit in the thickness of the sprayed coating (surface layer coat) is preferably not more than 500 μm, and more preferably not more than 300 μm.

The material making up the substrate is not particularly limited. Examples include metals such as stainless steel, aluminum, nickel, chromium, zinc, and alloys thereof; inorganic compounds (ceramics) such as alumina, zirconia, aluminum nitride, silicon nitride, silicon carbide and quartz glass; and carbon. A suitable material is selected according to the intended use of the spray-coated member (such as semiconductor equipment-related applications). For example, in the case of an aluminum metal or aluminum alloy substrate, an acid-resistant substrate that has been subjected to anodizing treatment is preferred. The shape of the substrate is not particularly limited; examples include flat planar shapes and cylindrical shapes.

When forming a sprayed coating on a substrate, it is preferable to, for example, acetone degrease the surface of the substrate on which the sprayed coating is to be formed and subject the substrate to roughening treatment using an abrasive such as corundum in order to increase the surface roughness Ra. By thus roughening the substrate, after thermal spraying has been carried out, delamination of the coating that arises from the difference in the coefficients of thermal expansion of the substrate and the sprayed coating can be suppressed. The degree of roughening treatment should be suitably adjusted according to, for example, the material making up the substrate.

The sprayed coating can be formed over an undercoat by first forming an underlayer coat on the substrate before forming the sprayed coating. The thickness of the undercoat can be set to, for example, from 50 to 300 μm. By forming the sprayed coating on an underlayer coat, and preferably in contact with an underlayer coat, it is possible to form the undercoat as an underlayer coat and the sprayed coating as a surface layer coat, enabling the films formed on the substrate to be rendered into a coating having a multilayer structure.

The undercoat material is exemplified by rare-earth oxides, rare-earth fluorides and rare-earth oxyfluorides. The rare-earth elements making up the undercoat are exemplified by the same rare-earth elements as in the film-forming material. The undercoat can be formed by a thermal spraying process such as atmospheric plasma spraying at normal pressure or suspension plasma spraying.

The undercoat has a porosity which is preferably not more than 5%, more preferably not more than 4%, and even more preferably not more than 3%. The porosity lower limit, although not particularly limited, is generally at least 0.1%. The undercoat has a surface roughness Ra which is preferably 10 μm or less, and more preferably 6 μm or less. A lower limit in the surface roughness Ra is better, but the lower limit is generally 0.1 μm or more. Forming the sprayed coating as a surface layer coat on an undercoat having a low surface roughness Ra, preferably in contact with the undercoat, is desirable because the surface roughness Ra of the surface layer coat can also be reduced.

The method of forming such an undercoat having a low porosity and a low surface roughness (Ra) is not particularly limited, For example, a dense undercoat having a low porosity and a low surface roughness Ra can be formed using as the starting material a single-particle powder or a granulated thermal spraying powder having an average particle size D50 of at least 0.5 μm, preferably at least 1 μm, and not more than 50 μm, preferably not more than 30 μm, by thoroughly melting the particles and carrying out thermal spraying by a process such as plasma spraying or detonation flame spraying. Here, "single-particle powder" refers to a powder of dense particles in the form of a spherical powder, angular powder, pulverized powder or the like. When using a single-particle powder, because the single-particle powder is a powder composed of particles which, though they are fine particles of a smaller size than granulated thermal spraying powder, are dense particles, an undercoat which has a small splat diameter and in which cracking is suppressed can be formed.

The surface roughness Ra of the undercoat can be lowered by surface finishing such as mechanical polishing (surface grinding, cylinder liner finishing, mirror finishing, etc.), blasting using very small beads or hand polishing using a diamond pad.

In the sprayed coating of the invention, at crystal phase diffraction peaks detected within a diffraction angle range of 2θ=10 to 70° in x-ray diffraction using the CuKα line as the characteristic x-ray, the value of $X_{ROF}$ computed from the formula $$X_{ROF} = I(ROF)/(I(RF) + I(RO))$$

(wherein I(ROF) is the integrated intensity of the largest diffraction peak attributable to the rare-earth oxyfluoride, I(RF) is the integrated intensity of the largest diffraction peak attributable to the rare-earth fluoride, and I(RO) is the integrated intensity of the largest diffraction peak attributable to the rare-earth oxide) is preferably at least 1.2. Here, when two or more compounds are present in the rare-earth oxyfluoride, in the rare-earth fluoride or in the rare-earth oxide, I(ROF), I(RF) and I(RO) are the sums of the integrated intensities of the largest diffraction peaks for each of the two or more compounds. The larger the XOF value, the higher the ratio of rare-earth oxyfluoride and the lower the ratios of rare-earth fluoride and rare-earth oxide present in the sprayed coating, which is advantageous from the standpoint of minimizing particle generation. The value of $X_{ROF}$ is more preferably at least 1.4, even more preferably at least 1.6, and still more preferably at least 1.8.

When the rare-earth element is, for example, yttrium (Y), the maximum peak for the rhombohedral system of yttrium oxyfluoride ($YOF(Y_1O_1F_1)$), although not particularly limited, is generally a diffraction peak attributable to the (012) plane of the crystal lattice. This diffraction peak is typically detected at about 2θ=28.7°. The largest peak in the rhombohedral system of yttrium oxyfluoride ($Y_5O_4F_7$), although not particularly limited, is generally a diffraction peak attributable to the (151) plane of the crystal lattice. This diffraction peak is typically detected at about 2θ=28.1°.

The method of forming the sprayed coating of the invention is not particularly limited, although atmospheric plasma spraying (APS) and atmospheric suspension plasma spraying (SPS) are preferred.

Examples of plasma gases that can be used to form the plasma in atmospheric plasma spraying include, without particular limitation, argon gas alone, nitrogen gas alone, and mixed gases of two or more selected from among argon gas, hydrogen gas, helium gas and nitrogen gas. The spraying distance in atmospheric plasma spraying is preferably not more than 150 mm. As the spraying distance becomes shorter, the film formation rate for the sprayed coating rises, in addition to which the hardness increases and the porosity becomes lower. The spraying distance is more preferably not more than 140 mm, and even more preferably not more than 130 mm. Although not subject to any particular lower limit, the spraying distance is preferably at least 50 mm, more preferably at least 60 mm, and even more preferably at least 70 mm.

Examples of plasma gases that can be used to form the plasma in suspension plasma spraying include, without particular limitation, mixed gases of two or more selected from among argon gas, hydrogen gas, helium gas and nitrogen gas; three-gas mixtures of argon gas, hydrogen gas and nitrogen gas and four-gas mixtures of argon gas, hydrogen gas, helium gas and nitrogen gas are more preferred. The spraying distance in suspension plasma spraying is preferably not more than 100 mm. As the spraying distance becomes shorter, the film formation rate for the sprayed coating rises, in addition to which the hardness increases and the porosity becomes lower. The spraying distance is more preferably not more than 90 mm, and even more preferably not more than 80 mm. Although not subject to any particular lower limit, the spraying distance is preferably at least 50 mm, more preferably at least 55 mm, and even more preferably at least 60 mm.

When forming a sprayed coating on a substrate or on a coat that has been formed on a substrate (undercoat), it is preferable to carry out thermal spraying while cooling the substrate, the coat that has been formed on the substrate (undercoat), and also the sprayed coating that is formed (surface layer coat). The cooling method is exemplified by air cooling and water cooling.

In particular, during thermal spraying, the temperature of the substrate and the coat that has been formed on the substrate is preferably not more than 200° C. At a lower temperature, the substrate or the substrate and the coat that has been formed on the substrate can be better protected from damage and deformation due to heat. Also, at a lower temperature, the generation of thermal stress can be better suppressed, and delamination between the substrate and the sprayed coating to be formed, or between a coat that has been formed on the substrate (undercoat) and the sprayed coating to be formed, can be better suppressed. The temperature of the substrate during thermal spraying, or of the substrate and a coat that has been formed on the substrate, is more preferably not more than 180° C., and even more preferably not more than 150° C. This temperature can be achieved by controlling the cooling capacity.

The temperature of the substrate at the time of thermal spraying, or of the substrate and a coat that has been formed on the substrate, is set to preferably at least 50° C. At a higher temperature, the bond between the substrate and the sprayed coating to be formed, or between a coat that has been formed on the substrate (undercoat) and the sprayed coating to be formed (surface layer coat), becomes stronger, enabling the sprayed coating to be made dense. The temperature of the substrate at the time of thermal spraying, or of the substrate and a coat that has been formed on the substrate, is more preferably at least 60'C, and even more preferably at least 80° C.

s Hitherto known conditions such as the film-forming material (film-forming slurry) feed rate, gas feed rate and applied power (current value, voltage value) may be employed without particular limitation as the other thermal spraying conditions in plasma spraying. Such other thermal spraying conditions may be suitably set according to the substrate, the film-forming material (film-forming slurry) and the intended use for the thermally sprayed component that is to be obtained. By using the film-forming material or film-forming slurry of the invention, the target sprayed coating can be obtained without requiring an excessive applied power.

In particular, when forming a sprayed coating directly on a substrate, by increasing the surface roughness Ra as noted above on the side of the substrate where the sprayed coating is to be formed and also setting the substrate to the above-indicated temperature, it is possible to form a sprayed coating which is more resistant to delamination, has a higher hardness and is dense. When this is done, because the surface roughness Ra of the sprayed coating that has been formed tends to become higher, lowering the surface hardness Ra by surface finishing such as mechanical polishing (surface grinding, cylinder liner finishing, mirror finishing, etc.), blasting using very small beads or hand polishing using a diamond pad enables a sprayed coating to be formed which is more resistant to delamination, has a higher hardness and is dense, and which moreover has a low surface hardness Ra and is smooth.

EXAMPLES

The invention is illustrated more fully below by way of Examples and Comparative Examples, although the invention is not limited by these Examples.

Example 1

[Production of Yttrium Fluoride Particles]

A 2 mol/L aqueous solution of yttrium nitrate in an amount corresponding to 2 moles of yttrium nitrate was heated to 50° C., a 12 mol/L aqueous solution of ammonium fluoride in an amount corresponding to 7 moles of ammonium fluoride was poured into the heated aqueous yttrium nitrate solution and mixed together, and the mixture was stirred for one hour while maintaining the temperature at 50° C. The resulting precipitate was filtered and washed, following which it was dried at 70° C. for 24 hours, giving an ammonium yttrium fluoride double salt. The resulting ammonium yttrium fluoride double salt was then fired at 850° C. for 4 hours using a tubular furnace under a nitrogen gas atmosphere, following which it was pulverized in a jet mill, giving yttrium fluoride particles.

[Evaluation of Yttrium Fluoride Particle Properties]

A 0.1 g amount of the resulting yttrium fluoride particles was mixed into 30 mL of pure water in a glass beaker having a maximum calibrated volume of 30 mL and subjected to 1 minute of ultrasonic dispersion treatment at 40 W, and the average particle size D50(F1), cumulative 90% size D90 (F1) and cumulative 10% size D10(F1) in the volume-based particle size distribution were measured. Also, 0.1 g of the resulting yttrium fluoride particles was mixed into 30 mL of pure water in a glass beaker having a maximum calibrated volume of 30 mL and subjected to 3 minutes of ultrasonic dispersion treatment at 40 W, and the average particle size D50(F3) in the volume-based particle size distribution was measured. The following values were computed from these results:

$$P_D = (D90(F1) - D10(F1))/D50(F1), \text{ and}$$

$$P_{FA} = D50(F1)/D50(F3).$$

In addition, the BET specific surface area and loose bulk density were measured. The results are shown in Table 1. The respective measurements and analyses are described later in detail.

[Production of Composite Particles]

Five moles of yttrium oxide particles having a cumulative 50% size (median size) in the volume-based particle size distribution of 2 μm was added to pure water and stirred to produce a slurry having an yttrium oxide particle concentration of 20 wt %. Twelve moles of acidic ammonium fluoride was poured into the resulting slurry and the mixture was aged at 50° C. for 3 hours. The resulting particles were filtered and washed, then dried at 70° C., giving composite particles containing yttrium oxide and ammonium yttrium fluoride.

[Production of Film-Forming Material]

A film-forming material was obtained by mixing the yttrium fluoride particles and composite particles produced by the above methods in a weight ratio of the yttrium fluoride particles to the composite particles of 40:60.

[Evaluation of Film-Forming Material Properties]

The crystal phases of the resulting film-forming material were identified from the diffraction peaks detected within a diffraction angle range of 2θ=10 to 70° in x-ray diffraction using the CuKα line as the characteristic x-ray, the crystal composition was analyzed, the largest peaks for each of the constituent crystal phases were determined, and the integrated intensity I(RNF) of the largest diffraction peak attributable to the ammonium rare-earth fluoride double oxide, the integrated intensity I(RF) of the largest diffraction peak attributable to the rare-earth fluoride and the integrated intensity I(RO) of the largest diffraction peak attributable to the rare-earth oxide were computed. The following values were computed from these results:

$$X_{FO} = I(RNF)/(I(RF) + I(RO)),$$

$$X_F = I(RNF)/I(RF), \text{ and}$$

$$X_O = I(RNF)/I(RO).$$

X-ray diffraction measurement was carried out using the X'Pert PRO/MPD x-ray diffractometer (Malvern Panalytical), and the crystal phases were identified and the integrated intensities computed using the HighScore Plus analysis software (Malvern Panalytical). The measurement conditions were as follows: characteristic x-ray, CuKα (tube voltage, 45 kV; tube current, 40 mA); scanning range, 2θ=5 to 70°; step size, 0.0167113°; time per step, 13.970 seconds; scan speed, 0.151921°/sec.

Figure 2:
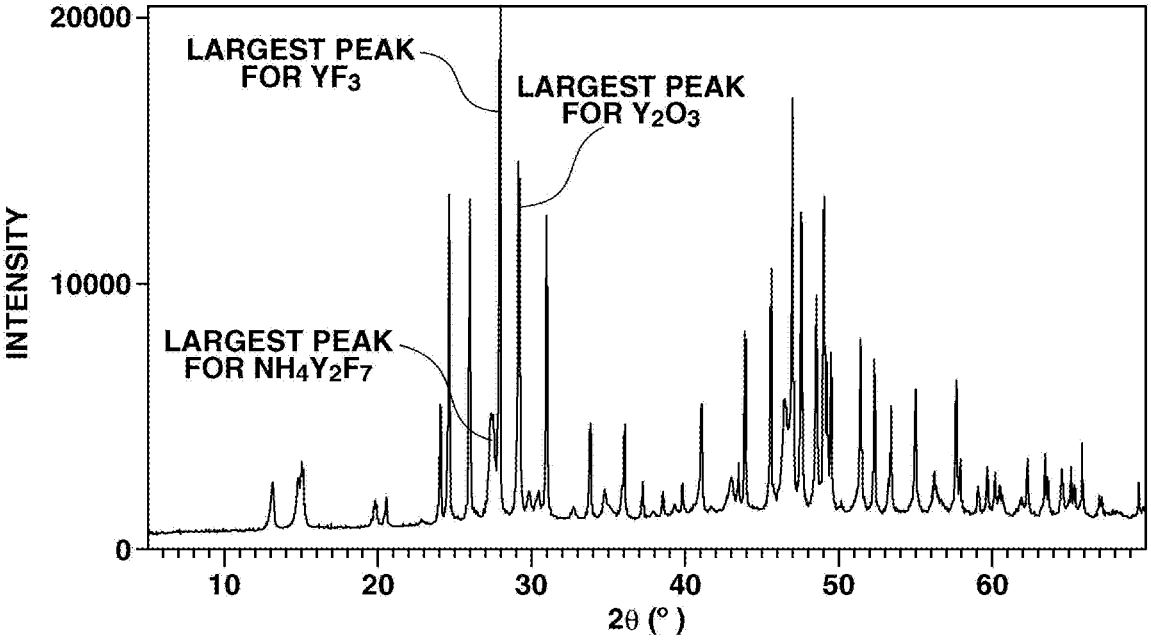
FIG. 2 is an x-ray diffraction profile of the film-forming material obtained in Example 1.

The loss on ignition of the resulting film-forming material when heated 2 hours in air at 500° C. was measured. The oxygen content was also measured. In addition, 0.1 g of the resulting film-forming material was mixed into 30 mL of pure water in a glass beaker having a maximum calibrated volume of 30 mL, subjected to 1 minute of ultrasonic dispersion treatment at 40 W, and the average particle size D50(S1) in the volume-based particle size distribution was measured. Also, 0.1 g of the resulting film-forming material was mixed into 30 mL of pure water in a glass beaker having a maximum calibrated volume of 30 mL, subjected to 3 minute of ultrasonic dispersion treatment at 40 W, and the average particle size D50(S3) in the volume-based particle size distribution was measured. The ratio of both:

$$P_{SA} = D50(S1)/D50(S3)$$

was computed from these results. The results are shown in Table 2. FIG. 1 shows a scanning electron micrograph and FIG. 2 shows an x-ray diffraction profile for the film-forming material obtained in Example 1. The respective measurements and analyses are described later in detail.

[Production of Film-Forming Slurry]

The film-forming material produced by the above method was mixed with a dispersion medium and dispersed, giving a film-forming slurry. The slurry concentration and the dispersion medium used are shown in Table 2.

[Evaluation of Film-Forming Slurry Properties]

The viscosity and pH of the slurry obtained were measured. The results are shown in Table 3. Measurement of the viscosity is described later in detail.

Example 2

[Production of Yttrium Fluoride Particles]

Aside from firing the resulting ammonium yttrium fluoride double salt for 2 hours at 800° C., yttrium fluoride particles were obtained in the same way as in Example 1.

[Evaluation of Yttrium Fluoride Particle Properties]

The properties were evaluated in the same way as in Example 1. The results are shown in Table 1.

[Production of Composite Particles]

Aside from using yttrium oxide particles having a cumulative 50% size (median size) in the volume-based particle size distribution as the yttrium oxide particles, composite particles were obtained in the same way as in Example 1.

[Production of Film-Forming Material]

The yttrium fluoride particles and composite particles produced by the above methods were mixed together to give a weight ratio of yttrium fluoride particles to composite particles of 45:55, thereby producing a film-forming material.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Example 3

[Production of Yttrium Fluoride Particles]

Aside from firing the resulting ammonium yttrium fluoride double salt for 2 hours at 440° C. and pulverizing it in a hammer mill, yttrium fluoride particles were obtained in to the same way as in Example 1.

[Evaluation of Yttrium Fluoride Particle Properties]

The properties were evaluated in the same way as in Example 1. The results are shown in Table 1.

[Production of Composite Particles]

Aside from changing the amount of acidic ammonium fluoride to 7 moles, composite particles were obtained in the same way as in Example 1.

[Production of Film-Forming Material]

The yttrium fluoride particles and composite particles produced by the above methods were mixed together to give a weight ratio of yttrium fluoride particles to composite particles of 50:50 and carboxymethyl cellulose was added as a binder, thereby producing a slurry. The resulting slurry was granulated using a spray dryer, thereby giving a granular film-forming material.

[Evaluation of Film-Forming Material Properties]

Instead of measuring the average particle size D50(S1) and the average particle size D50(S3) and computing the value of $P_{SA}$, the average particle size D50(S0) in the volume-based particle size distribution was measured without carrying out ultrasonic dispersion treatment. Aside from this, the properties were evaluated in the same way as in Example 1. The results are shown in Table 2.

Example 4

[Production of Yttrium Fluoride Particles]

Aside from firing the resulting ammonium yttrium fluoride double salt for 2 hours at 950° C., yttrium fluoride particles were obtained in the same way as in Example 1.

[Evaluation of Yttrium Fluoride Particle Properties]

The properties were evaluated in the same way as in Example 1. The results are shown in Table 1.

[Production of Composite Particles]

Aside from changing the amount of acidic ammonium fluoride to 7 moles, composite particles were obtained in the same way as in Example 1.

[Production of Film-Forming Material]

The yttrium fluoride particles and composite particles produced by the above methods were mixed together to give a weight ratio of yttrium fluoride particles to composite particles of 60:40, thereby producing a film-forming material.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Example 5

[Production of Ytterbium Fluoride Particles]

A 2 mol/L aqueous solution of ytterbium nitrate in an amount corresponding to 2 moles of ytterbium nitrate was heated to 50° C., a 12 mol/L aqueous solution of ammonium fluoride in an amount corresponding to 7 moles of ammonium fluoride was poured into the heated aqueous ytterbium nitrate solution and mixed together, and the mixture was stirred for one hour while maintaining the temperature at 50° C. The resulting precipitate was filtered and washed, following which it was dried at 70° C. for 24 hours, giving an ammonium to ytterbium fluoride double salt. The resulting ammonium ytterbium fluoride double salt was then fired at 900° C. for 2 hours using a tubular furnace under a nitrogen gas atmosphere, following which it was pulverized in a jet mill, giving ytterbium fluoride particles.

[Evaluation of Ytterbium Fluoride Particle Properties]

The properties were evaluated in the same way as the yttrium fluoride particle properties in Example 1. The results are shown in Table 1.

[Production of Composite Particles]

Five moles of ytterbium oxide particles having a cumulative 50% size (median size) in the volume-based particle size distribution of 1 μm was added to pure water and stirred to produce a slurry having an ytterbium oxide particle concentration of 20 wt %. Ten moles of acidic ammonium fluoride was poured into the resulting slurry and the mixture was aged at 50° C. for 3 hours. The resulting particles were filtered and washed, then dried at 70° C., giving composite particles containing ytterbium oxide and ammonium ytterbium fluoride.

[Production of Film-Forming Material]

A film-forming material was obtained by mixing the ytterbium fluoride particles and composite particles produced in the above method in a weight ratio of the ytterbium fluoride particles to the composite particles of 65:35.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Example 6

[Production of Scandium Fluoride Particles]

A 2 mol/L aqueous solution of scandium nitrate in an amount corresponding to 2 moles of scandium nitrate was heated to 50° C., a 12 mol/L aqueous solution of ammonium fluoride in an amount corresponding to 7 moles of ammonium fluoride was poured into the heated aqueous scandium nitrate solution and mixed together, and the mixture was stirred for one hour while maintaining the temperature at 50° C. The resulting precipitate was filtered and washed, following which it was dried at 70° C. for 24 hours, giving an ammonium scandium fluoride double salt. The resulting ammonium scandium fluoride double salt was then fired at 850° C. for 2 hours using a tubular furnace under a nitrogen gas atmosphere, following which it was pulverized in a jet mill, giving scandium fluoride particles.

[Evaluation of Scandium Fluoride Particle Properties]

The properties were evaluated in the same way as the yttrium fluoride particle properties in Example 1. The results are shown in Table 1.

[Production of Composite Particles]

Five moles of scandium oxide particles having a cumulative 50% size (median size) in the volume-based particle size distribution of 1 μm was added to pure water and stirred to produce a slurry having a scandium oxide particle concentration of 20 wt %. Nine moles of acidic ammonium fluoride was poured into the resulting slurry and the mixture was aged at 50° C. for 3 hours. The resulting particles were filtered and washed, then dried at 70° C., giving composite particles containing scandium oxide and ammonium scandium fluoride.

[Production of Film-Forming Material]

A film-forming material was obtained by mixing the scandium fluoride particles and composite particles produced in the above method in a weight ratio of the scandium fluoride particles to the composite particles of 40:60.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Example 7

[Production of Erbium Fluoride Particles]

A 2 mol/L aqueous solution of erbium nitrate in an amount corresponding to 2 moles of erbium nitrate was heated to 50° C., a 12 mol/L aqueous solution of ammonium fluoride in an amount corresponding to 7 moles of ammonium fluoride was poured into the heated aqueous erbium nitrate solution and mixed together, and the mixture was stirred for one hour while maintaining the temperature at 50° C. The resulting precipitate was filtered and washed, following which it was dried at 70° C. for 24 hours, giving an ammonium erbium fluoride double salt. The resulting ammonium erbium fluoride double salt was then fired at 900° C. for 2 hours using a tubular furnace under a nitrogen gas atmosphere, following which it was pulverized in a jet mill, giving erbium fluoride particles.

[Evaluation of Erbium Fluoride Particle Properties]

The properties were evaluated in the same way as the yttrium fluoride particle properties in Example 1. The results are shown in Table 1.

[Production of Composite Particles]

Five moles of erbium oxide particles having a cumulative 50% size (median size) in the volume-based particle size distribution of 2 pin was added to pure water and stirred to produce a slurry having an erbium oxide particle concentration of 20 wt %. Ten moles of acidic ammonium fluoride was poured into the resulting slurry and the mixture was aged at 50° C. for 3 hours. The resulting particles were filtered and washed, then dried at 70° C., giving composite particles containing erbium oxide and ammonium erbium fluoride.

[Production of Film-Forming Material]

A film-forming material was obtained by mixing the erbium fluoride particles and composite particles produced in the above method in a weight ratio of the erbium fluoride particles to the composite particles of 55:45.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Comparative Example 1

[Production of Composite Particles and Film-Forming Material]

Composite particles were obtained by the same method as in Example 2, and were then rendered into a film-forming material.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Comparative Example 2

[Production of Composite Particles and Film-Forming Material]

Composite particles were obtained by the same method as in Example 1. The resulting composite particles were fired for 5 hours at 900° C. in an air atmosphere furnace, following which they were pulverized in a jet mill, giving particles containing a crystal phase of yttrium oxyfluoride and a crystal phase of yttrium fluoride. This was used as the film-forming material.

[Evaluation of Film-Forming Material Properties]

The properties were evaluated out in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

Comparative Example 3

[Production of Yttrium Fluoride Particles]

A 2 mol/L aqueous solution of yttrium nitrate in an amount corresponding to 2 moles of yttrium nitrate was heated to 50° C., a 12 mol/L aqueous solution of ammonium fluoride in an amount corresponding to 7 moles of ammonium fluoride was poured into the heated aqueous yttrium nitrate solution and mixed together, and the mixture was stirred for one hour while maintaining the temperature at 50° C. The resulting precipitate was filtered and washed, following which it was dried at 70° C. for 24 hours, giving an ammonium yttrium fluoride double salt. The resulting ammonium yttrium fluoride double salt was then fired at 650° C. for 2 hours using a tubular furnace under a nitrogen gas atmosphere, following which it was pulverized in a jet mill, giving yttrium fluoride particles.

[Evaluation of Yttrium Fluoride Particle Properties]

The properties were evaluated in the same way as in Example 1. The results are shown in Table 1.

[Production of Film-Forming Material]

A film-forming material was obtained by mixing the yttrium fluoride particles produced by the above method and yttrium oxide particles having a cumulative 50% size (median size) in the volume-based particle size distribution of 2 μm in a weight ratio of the yttrium fluoride particles to the yttrium oxide particles of 75:25.

[Evaluation of Film-Forming Material Properties]

The properties were evaluated in the same way as in Example 1. The results are shown in Table 2.

[Production of Film-Forming Slurry]

Production was carried out in the same way as in Example 1.

[Evaluation of Film-Forming Slurry Properties]

The properties were evaluated in the same way as in Example 1. The results are shown in Table 3.

TABLE 1

| | Example | | | | | | | Comparative Example | | |
|---|---|---|---|---|---|---|---|---|---|---|
| | 1 | 2 | 3 | 4 | 5 | 6 | 7 | 1 | 2 | 3 |
| Rare-earth fluoride | $YF_3$ | $YF_3$ | $YF_3$ | $YF_3$ | $YbF_3$ | $ScF_3$ | $ErF_3$ | none | none | $YF_3$ |
| Ammonium rare-earth fluoride double salt treatment temperature (° C.) | 850 | 800 | 440 | 950 | 900 | 850 | 900 | — | — | 650 |
| Ammonium rare-earth fluoride double salt treatment time (hr) | 4 | 2 | 2 | 2 | 2 | 2 | 3 | — | — | 2 |
| Rare-earth fluoride pulverization/disintegration method | jet mill | jet mill | hammer mill | jet mill | jet mill | jet mill | jet mill | — | — | jet mill |
| D10(F1) (μm) | 2.0 | 1.3 | 0.4 | 3.0 | 1.6 | 2.2 | 2.3 | — | — | 0.8 |
| D50(F1) (μm) | 3.4 | 2.4 | 0.8 | 5.7 | 3.7 | 3.3 | 4.0 | — | — | 1.9 |
| D90(F1) (μm) | 5.3 | 4.2 | 3.3 | 9.6 | 6.1 | 4.9 | 7.1 | — | — | 3.6 |
| D50(F3) (μm) | 3.3 | 2.3 | 0.7 | 5.6 | 3.7 | 3.3 | 4.0 | — | — | 1.8 |
| $P_D$ = (D90(F1)-D10(F1))/D50(F1) | 0.97 | 1.21 | 3.63 | 1.16 | 1.22 | 0.82 | 1.20 | — | — | 1.47 |
| $P_{FA}$ = D50(F1)/D50(F3) | 1.01 | 1.03 | 1.10 | 1.02 | 1.00 | 1.01 | 1.01 | — | — | 1.05 |
| BET specific surface area ($m^2/g$) | 0.8 | 1.4 | 9.7 | 0.6 | 0.5 | 2.1 | 0.8 | — | — | 3.3 |
| Loose bulk density ($g/cm^3$) | 1.13 | 0.82 | 0.61 | 1.46 | 1.95 | 0.77 | 1.73 | — | — | 0.58 |

TABLE 2

| | Example | | | | | | | Comparative Example | | |
|---|---|---|---|---|---|---|---|---|---|---|
| | 1 | 2 | 3 | 4 | 5 | 6 | 7 | 1 | 2 | 3 |
| XRD crystal phases | $YF_3$ $Y_2O_3$ $NH_4Y_2F_7$ | $YF_3$ $Y_2O_3$ $NH_4Y_2F_7$ | $YF_3$ $Y_2O_3$ $NH_4Y_2F_7$ | $YF_3$ $Y_2O_3$ $NH_4Y_2F_7$ | $YbF_3$ $Yb_2O_3$ $NH_4Y_2F_7$ | $ScF_3$ $Sc_2O_3$ $(NH_4)_1ScF_6$ | $ErF_3$ $Er_2O_3$ $NH_4Er_2F_7$ | $Y_2O_3$ $NH_4Y_2F_7$ | $YF_3$ $Y_5O_4F_7$ | $YF_3$ $Y_2O_3$ |
| $X_{FO}$ = I(RNF)/(I(RF) + I(RO)) | 0.13 | 0.08 | 0.13 | 0.13 | 0.27 | 0.07 | 0.23 | 0.63 | — | — |
| $X_F$ = I(RNF)/I(RF) | 0.25 | 0.17 | 0.38 | 0.37 | 0.50 | 0.17 | 0.50 | — | — | — |
| $X_O$ = I(RNF)/I(RO) | 0.28 | 0.15 | 0.20 | 0.21 | 0.58 | 0.11 | 0.42 | 0.63 | — | — |
| Ignition loss (wt %) | 4.8 | 3.3 | 3.7 | 5.5 | 6.2 | 2.1 | 3.8 | 8.1 | <0.1 | <0.1 |
| D50(S0) (μm) | — | — | 46.3 | — | — | — | — | — | — | — |
| D50(S1) (μm) | 4.0 | 2.7 | — | 8.2 | 4.4 | 3.9 | 4.2 | 3.6 | 3.2 | 3.5 |
| D50(S3) (μm) | 3.5 | 2.5 | — | 7.3 | 4.0 | 3.4 | 3.7 | 2.9 | 3.2 | 3.5 |
| $P_{SA}$ = D50(S1)/D50(S3) | 1.14 | 1.10 | — | 1.12 | 1.11 | 1.14 | 1.12 | 1.23 | 1.00 | 1.01 |
| Oxygen content (wt %) | 3.16 | 4.13 | 6.15 | 5.71 | 1.50 | 9.14 | 2.11 | 7.03 | 2.85 | 5.83 |

TABLE 3

| | Example | | | | | | Comparative Example | | |
|---|---|---|---|---|---|---|---|---|---|
| | 1 | 2 | 4 | 5 | 6 | 7 | 1 | 3 | 3 |
| Slurry concentration (wt %) | 30 | 50 | 40 | 60 | 25 | 30 | 30 | 30 | 30 |
| Dispersion medium (wt %) | IPA | ethanol | ethanol | IPA | ethanol | IPA | IPA | ethanol | IPA |
| IPA: isopropyl alcohol | (100) | (50) | (100) | (100) | (100) | (100) | (100) | (100) | (50) |
| | | IPA | | | | | | | water |
| | | (50) | | | | | | | (50) |
| Slurry viscosity (mPa · s) | 4 | 6 | 8 | 10 | 5 | 5 | 60 | 4 | 5 |
| pH | 7.1 | 9.9 | 7.5 | 8.2 | 7.7 | 7.4 | 8.3 | 8.0 | 7.5 |

Example 8

The surfaces of an A5052 aluminum alloy substrate measuring 100 mm-100 mm×5 mm were acetone degreased, and one side of the substrate was roughened by blasting with a 150-grit corundum abrasive. A sprayed coating was formed directly on the substrate by atmospheric suspension plasma spraying (SPS) using the film-forming slurry obtained in Example 1, thereby giving a spray-coated member. Here and below, atmospheric suspension plasma spraying was carried out in an air atmosphere, at normal pressure and under the spraying conditions shown in Table 4 using the 100HE plasma sprayer (Progressive Surface) and the LiquifeederHE spray-coating material feed system (Progressive Surface).

The crystal phases of the resulting sprayed coating were identified via x-ray diffraction by a method similar to that in Example 1, the crystal composition was analyzed, the largest peaks for each crystal phase component were determined, and the integrated intensity I(ROF) of the largest diffraction peak attributable to the rare-earth oxyfluorides (ROF ($R_1O_1F_1$), $R_4O_3F_6$, $R_5O_4F_7$, $R_6O_5Fa$, $R_7O_6F_9$, $R_{17}O_{14}F_{23}$, $RO_2F$, $ROF_2$ (wherein R is one or more element selected from rare-earth elements inclusive of Sc and Y), the integrated intensity I(RF) of the largest diffraction peak attributable to the rare-earth fluoride and the integrated intensity I(RO) of the largest diffraction peak attributable to the rare-earth oxide were computed. The following value was computed from these results.

$$X_{ROF} = I(ROF)/(I(RF) + I(RO))$$

In addition, the oxygen content, film thickness, surface roughness Ra and amount of R particles were measured. Details on each of the measurements, analysis and evaluations are described later.

Example 9

Aside from using the film-forming slurry obtained in Example 2, a sprayed coating was formed on the substrate in the same way as in Example 8, giving a spray-coated member. Measurements, analysis and evaluations like those in Example 8 were carried out on the sprayed coating thus obtained. The results are shown in Table 5.

Example 10

The surfaces of an A5052 aluminum alloy substrate measuring 100 mm-100 mm×5 mm were acetone degreased, and one side of the substrate was roughened by blasting with a 150-grit corundum abrasive. A sprayed coating was formed directly on the substrate by atmospheric plasma spraying (APS) using the granular film-forming slurry obtained in Example 3, thereby giving a spray-coated member. Atmospheric plasma spraying was carried out in an air atmosphere, at normal pressure and under the spraying conditions shown in Table 4 using the $F_4$ plasma sprayer (Oerlikon Metco) and the TWIN-10 spray-coating material feed system (Oerlikon Metco). Measurements, analysis and evaluations like those in Example 8 were carried out on the sprayed coating thus obtained. The results are shown in Table 5.

Example 11

Aside from using the film-forming slurry obtained in Example 4, a sprayed coating was formed on the substrate in the same way as in Example 8, giving a spray-coated member. Measurements, analysis and evaluations like those in Example 8 were carried out on the sprayed coating thus obtained. The results are shown in Table 5.

Example 12

Aside from using the film-forming slurry obtained in Example 5, a sprayed coating was formed on the substrate in the same way as in Example 8, giving a spray-coated member. Measurements, analysis and evaluations like those in Example 8 were carried out on the sprayed coating thus obtained. The results are shown in Table 5.

Example 13

Aside from using the film-forming slurry obtained in Example 6, a sprayed coating was formed on the substrate in the same way as in Example 8, giving a spray-coated member. Measurements, analysis and evaluations like those in Example 8 were carried out on the sprayed coating thus obtained. The results are shown in Table 5.

Example 14

Aside from using the film-forming shiny obtained in Example 7, a sprayed coating was formed on the substrate in the same way as in Example 8, giving a spray-coated member. Measurements, analysis and evaluations like those in Example 8 were carried out on the sprayed coating thus obtained. The results are shown in Table 5.

Comparative Example 4

Aside from using the film-forming slurry obtained in Comparative Example 1, a sprayed coating was formed on the substrate in the same way as in Example 8, giving a spray-coated member. Measurements, analysis and evaluations like those in Example 8 were carried out on the sprayed coating thus obtained. The results are shown in Table 5.

Comparative Example 5

Aside from using the film-forming slurry obtained in Comparative Example 2, a sprayed coating was formed on the substrate in the same way as in Example 8, giving a spray-coated member. Measurements, analysis and evaluations like those in Example 8 were carried out on the sprayed coating thus obtained. The results are shown in Table 5.

Comparative Example 6

Aside from using the film-forming slurry obtained in Comparative Example 3, a sprayed coating was formed on the substrate in the same way as in Example 8, giving a spray-coated member. Measurements, analysis and evaluations like those in Example 8 were carried out on the sprayed coating thus obtained. The results are shown in Table 5.

TABLE 4

| | Example | | | | | | | Comparative Example | | |
|---|---|---|---|---|---|---|---|---|---|---|
| | 8 | 9 | 10 | 11 | 12 | 13 | 14 | 4 | 5 | 6 |
| Spray-costing method | SPS | SPS | APS | SPS | SPS | SPS | SPS | SPS | SPS | SPS |
| Ar (L/min) | 150 | 150 | 40 | 150 | 150 | 150 | 150 | 150 | 180 | 150 |
| $N_2$ (L/min) | 60 | 60 | 0 | 60 | 60 | 60 | 60 | 60 | 70 | 60 |
| $H_2$ (L/min) | 60 | 60 | 6 | 60 | 60 | 60 | 60 | 60 | 70 | 60 |
| Slurry feed rate (mL/min) | 30 | 30 | — | 30 | 30 | 30 | 30 | 30 | 30 | 30 |
| Film-forming material feed rate (g/min) | — | — | 20 | — | — | — | — | — | — | — |
| Current (A) | 370 | 370 | 600 | 370 | 370 | 370 | 370 | 370 | 407 | 370 |
| Voltage (V) | 243 | 243 | 61 | 243 | 243 | 243 | 243 | 243 | 258 | 243 |
| Power (kW) | 90 | 90 | 36 | 90 | 90 | 90 | 90 | 90 | 105 | 90 |
| Spraying distance (mm) | 75 | 75 | 120 | 75 | 75 | 75 | 75 | 75 | 75 | 75 |
| Substrate temperatuure (C) | 130 | 130 | 90 | 130 | 120 | 140 | 100 | 120 | 210 | 110 |

TABLE 5

| | Example | | | | | | | Comparative Example | | |
|---|---|---|---|---|---|---|---|---|---|---|
| | 8 | 9 | 10 | 11 | 12 | 13 | 14 | 4 | 5 | 6 |
| XRD crystal phases | $Y_5O_4F_7$ YOF $YF_3$ | $Y_7O_6F_9$ YOF $YF_3$ $Y_2O_3$ | $Y_5O_4F_7$ $YF_3$ | $Y_5O_4F_7$ YF $YF_3$ $Y_2O_3$ | $Yb_5O_4F_7$ YbOF $YbF_3$ $Yb_2O_3$ | ScOF $ScF_3$ $Sc_2O_3$ | ErOF $ErF_3$ $Er_2O_3$ | $Y_2O_3$ YOF $YF_3$ | YOF $Y_2O_3$ $YF_3$ | $Y_2O_3$ $YF_3$ YOF |
| $X_{ROF}$ = I(ROF)/(I(RF) + I(RO)) | 2.8 | 1.8 | 2.4 | 3.3 | 2.0 | 2.8 | 2.2 | 0.9 | 1.1 | 1.0 |
| Oxygen content (wt %) | 5.7 | 7.2 | 8.4 | 9.2 | 4.7 | 17.2 | 5.5 | 11.2 | 12.4 | 8.8 |
| Film thickness (μm) | 98 | 103 | 105 | 100 | 91 | 95 | 99 | 92 | 107 | 101 |
| Surface roughness Ra (μm) | 1.5 | 1.6 | 4.4 | 1.8 | 2.0 | 1.3 | 1.8 | 2.1 | 1.5 | 4.6 |
| R particles (μg/cm$^2$) | 0.1 | 0.5 | 0.3 | 0.5 | 0.1 | 0.9 | 0.2 | 2.4 | 1.9 | 3.1 |

In the sprayed coatings obtained in Examples 8 to 14, the $X_{ROF}$ values computed from, in x-ray diffraction, the integrated intensity I(ROF) of the largest diffraction peak attributable to rare-earth oxyfluorides (when two or more compounds are present, the sum of the integrated intensities of the largest diffraction peaks for each of the two or more compounds), the integrated intensity I(RF) of the largest diffraction peak attributable to the rare-earth fluoride and the integrated intensity I(RO) of the largest diffraction peak attributable to the rare-earth oxide are all 1.2 or more. In these cases, it is apparent that sprayed coatings are obtained in which the main phase among the crystal phases of the sprayed coating is a rare-earth oxyfluoride, and that the ratios of rare-earth fluoride and rare-earth oxide present are low.

The film-forming materials obtained in Examples 1 to 7 are composed of particles containing a crystal phase of a rare-earth fluoride and composite particles (particles containing a crystal phase of a rare-earth oxide and particles containing a crystal phase of an ammonium rare-earth fluoride double salt, or particles containing a crystal phase of a rare-earth oxide and a crystal phase of an ammonium rare-earth fluoride double salt). In x-ray diffraction, the $X_{FO}$, $X_F$ and $X_O$ values computed from the integrated intensity I(RNF) of the largest diffraction peak attributable to the ammonium rare-earth fluoride, the integrated intensity I(RF) of the largest diffraction peak attributable to the rare-earth fluoride and the integrated intensity I(RO) of the largest diffraction peak attributable to the rare-earth oxide are all 0.01 or more. It is apparent that, because composite particles are included in the film-forming material, the reactivity during the thermal spraying process becomes higher and a sprayed coating having a high ratio of rare-earth oxyfluoride present and low ratios of rare-earth fluoride and rare-earth oxide can be produced without requiring excessive thermal spraying heat.

By contrast, with regard to the sprayed coating obtained in Comparative Example 4, because particles containing a crystal phase of a rare-earth fluoride are not included in the film-forming material of Comparative Example 1, the main phase among the crystal phases in the sprayed coating is a rare-earth oxide. Also, with regard to the sprayed coating obtained in Comparative Example 5, because particles containing a crystal phase of a rare-earth oxide are not included in the film-forming material of Comparative Example 2 and, in reactions between the rare-earth fluoride and the rare-earth oxyfluoride, the rare-earth fluoride is not completely consumed and rare-earth oxide formation is not suppressed, much unreacted rare-earth fluoride remains present and rare-earth oxide ends up forming as a by-product. In particular, with the film-forming material of Comparative Example 2 that was used in Comparative Example 5, it is necessary, among the thermal spraying conditions, to increase the power in order to have the main phase among the crystal phases of the sprayed coating be an oxyfluoride of a rare-earth element. Moreover, with regard to the sprayed coating obtained in Comparative Example 6, because the film-forming material of Comparative Example 3 does not include particles containing a crystal phase of an ammonium rare-earth fluoride, the reaction between rare-earth fluoride and rare-earth oxide does not fully proceed within a very brief time during the thermal spraying process, and so much unreacted rare-earth fluoride and rare-earth oxide ends up remaining as crystal phases in the sprayed coating.

[Measurement of Particle Size Distribution]

The particle size distribution was measured by the laser diffraction method. The Microtrac MT3300EX II laser diffraction/scattering-type particle size analyzer (Microtrac-Bell KK) was used for measurement. The sample was poured or added dropwise to the circulation system of the measurement apparatus such that the concentration index DV (diffraction volume) compatible for use of the measurement apparatus becomes from 0.01 to 0.09.

[Measurement of BET Specific Surface Area]

Measured using the Macsorb HM model-1208 fully automatic specific surface area analyzer (Mountech Co., Ltd.).

[Loose Bulk Density]

Measured using the PT-X powder tester (Hosokawa Micron Corporation).

[Measurement of Ignition Loss]

A sample of the film-forming material was placed in a platinum crucible and heated in air for 2 hours at 500° C. using an electric furnace, and the ignition loss was computed from the sample weights before and after heating.

[Measurement of Oxygen Content]

Measured by the inert-gas fusion-infrared absorption method.

[Measurement of Slurry Viscosity]

Measured using the TVB-10 viscometer (Told Sangyo) at a rotational velocity of 60 rpm and a rotational time of 1 minute.

[Measurement of Film Thickness]

Measured using the LH-300J overcurrent film thickness meter (Kett Electric Laboratory).

[Measurement of Surface Roughness Ra]

Measured using the HANDYSURF E-35A surface texture measuring instrument (Tokyo Seimitsu Co., Ltd.).

[Particle Evaluation Test (Amount of R Particles)]

A spray-coated member test piece having a surface area of 20 mm×20 mm (4 $cm^2$) on which had been formed a sprayed coating was immersed in ultrapure water with the sprayed coating side facing the water surface and sonic cleaning (output, 200 W; irradiation time, 30 minutes) was carried out on the test piece while in this state, thereby removing post-spraying contamination. The test piece was then dried, after which it was immersed in 20 mL of ultrapure water within a 100 mL polyethylene bottle with the sprayed coating side facing the bottom of the polyethylene bottle and sonic cleaning (output, 200 W; irradiation time, 15 minutes) was carried out on the test piece while in this state. Following ultrasonic treatment, the test piece was taken out, 2 mL of a 5.3N aqueous nitric acid solution was added to the liquor following ultrasonic treatment, and the R particles (rare-earth compound particles) present within the liquor were dissolved. The amount of rare-earth element (amount of R) included in the liquor was measured by ICP emission spectroscopy and evaluated as the R weight with respect to the surface area (4 $cm^2$) of the sprayed coating on the test piece. A smaller value signifies that there are fewer R particles on the surface portion of the sprayed coating.

The invention claimed is:

1. A film-forming material comprising:

particles containing a crystal phase of a rare-earth fluoride;

particles containing a crystal phase of a rare-earth oxide; and particles containing a crystal phase of an ammonium rare-earth fluoride double salt.

2. The film-forming material of claim 1, wherein the particles containing the crystal phase of the rare-earth oxide and the particles containing the crystal phase of the ammonium rare-earth fluoride double salt form composite particles in which they are mutually dispersed.

3. The film-forming material of claim 1, wherein the particles containing the crystal phase of the rare-earth oxide are rare-earth oxide particles, and the particles containing the crystal phase of the ammonium rare-earth fluoride double salt are ammonium rare-earth fluoride double salt particles.

4. A film-forming material comprising;

particles containing a crystal phase of a rare-earth fluoride; and particles containing a crystal phase of a rare-earth oxide and a crystal phase of an ammonium rare-earth fluoride double salt.

5. The film-forming material of claim 4, wherein the particles containing the crystal phase of the rare-earth oxide and the crystal phase of the ammonium rare-earth fluoride double salt form composite particles in which particles containing the crystal phase of the rare-earth oxide serve as a matrix, and particles or a layer containing the crystal phase of the ammonium rare-earth fluoride double salt are dispersed at a surface and/or an interior of the particles containing the crystal phase of the rare-earth oxide.

6. The film-forming material of claim 5, wherein the particles containing the crystal phase of the rare-earth oxide are rare-earth oxide particles, and the particles or layer containing the crystal phase of the ammonium rare-earth fluoride double salt are particles or a layer of the ammonium rare-earth fluoride double salt.

7. The film-forming material of claim 1, wherein the particles containing the crystal phase of the rare-earth fluoride are rare-earth fluoride particles.

8. The film-forming material of claim 1, wherein the material does not contain a crystal phase of a rare-earth oxyfluoride.

9. The film-forming material of claim 1, wherein the ammonium rare-earth fluoride double salt includes one or more selected from the group consisting of $(NH_4)_3R^3F_6$, $NH_4R^3F_4$, $NH_4R^3{}_2F_7$ and $(NH_4)_3R^3{}_2F_9$, wherein each $R^3$ is one or more selected from rare-earth elements inclusive of Sc and Y.

10. The film-forming material of claim 1, wherein the material has an oxygen content of from 0.3 to 10 wt %.

11. The film-forming material of claim 1 wherein, at crystal phase diffraction peaks detected within a diffraction angle range of 2θ=10 to 70° in x-ray diffraction using the CuKα line as the characteristic x-ray, $X_{F0}$ has a value of 0.01 or more, wherein the $X_{F0}$ is computed from the formula $$X_{F0} = I(RNF)/(I(RF) + I(RO)),$$

wherein I(RNF) is the integrated intensity of the largest diffraction peak attributable to the ammonium rare-earth fluoride double salt, I(RF) is the integrated intensity of the largest diffraction peak attributable to the rare-earth fluoride, and I(RO) is the integrated intensity of the largest diffraction peak attributable to the rare-earth oxide.

12. The film-forming material of claim 1, wherein the particles containing the crystal phase of the rare-earth fluoride have an average particle size D50(F1), defined as the cumulative 50% size as a median size in the volume-based particle size distribution measured after mixing the particles in 30 mL of water and one minute of ultrasonic dispersion treatment at 40 W, of from 0.5 to 10 μm.

13. The film-forming material of claim 1 wherein, in the particle size distribution of the particles containing the crystal phase of the rare-earth fluoride, the value of $P_D$ is 4 or less, wherein the value of $P_D$ is computed from the following formula, $$P_D = \{(D90(F1) - D10(F1))/D50(F1)$$

wherein D90(F1) is the cumulative 90% size in the volume-based particle size distribution measured after mixing the particles in 30 mL of water and one minute of ultrasonic dispersion treatment at 40 W, D10(F1) is the cumulative 10% size in the volume-based particle size distribution measured after mixing the particles in 30 mL of water and one minute of ultrasonic dispersion treatment at 40 W, and D50(F1) is the cumulative 50% size as a median size in the volume-based particle size distribution measured after mixing the particles in 30 mL of water and one minute of ultrasonic dispersion treatment at 40 W.

14. The film-forming material of claim 1, wherein the particles containing the crystal phase of the rare-earth fluoride have a BET specific surface area of 10 $m^2/g$ or less.

15. The film-forming material of claim 1, wherein the particles containing the crystal phase of the rare-earth fluoride has a loose bulk density of at least 0.6 g/cm3.

16. The film-forming material of claim 1, wherein the material is in the form of a powder or granules.

17. The film-forming material of claim 16, wherein the material has an average particle size D50(S0), defined as the cumulative 50% size as a median size in a volume-based particle size distribution, of from 10 to 100 μm.

18. A film-forming slurry comprising the film-forming material of claim 1 and a dispersion medium.

19. The film-forming slurry of claim 18, wherein the slurry has a concentration of from 10 to 70 wt %.

20. The film-forming slurry of claim 18, wherein the dispersion medium includes a nonaqueous solvent.

21. The film-forming slurry of claim 18, wherein the slurry has an average particle size D50(S1), defined as the cumulative 50% size as a median size in the volume-based particle size distribution measured after mixing the particles in 30 mL of water and one minute of ultrasonic dispersion treatment at 40 W, of from 1 to 10 μm.

22. The film-forming slurry of claim 18, wherein the value of PSA is at least 1.04, wherein the value of PSA is computed from the following formula, $$P_{SA} = D50(S1)/D50(S3),$$

wherein D50(S1) is an average particle size defined as the cumulative 50% size as a median size in the volume-based particle size distribution measured after mixing the slurry in 30 mL of water and one minute of ultrasonic dispersion treatment at 40 W and D50(S3) is an average particle size defined as the cumulative 50% size as a median size in the volume-based particle size distribution measured after mixing the slurry in 30 mL of water and 3 minutes of ultrasonic dispersion treatment at 40 W.

23. The film-forming slurry of claim 18, wherein the film-forming material has a loss on ignition in air at 500° C. for 2 hours of at least 0.5 wt %.

24. The film-forming material of claim 1 which is a spray-coating material.

25. The film-forming slurry of claim 18 which is a spray-coating slurry.

* * * * *